US006722063B1

(12) United States Patent
Uchikoshi

(10) Patent No.: US 6,722,063 B1
(45) Date of Patent: Apr. 20, 2004

(54) SHIRTS PRESS WITH FUNCTION FOR EXTENDING CLOTH

(75) Inventor: Mitsuyuki Uchikoshi, Tokyo (JP)

(73) Assignee: Sankousha Co., Ltd. (JP)

( * ) Notice: Subject to any disclaimer, the term of this patent is extended or adjusted under 35 U.S.C. 154(b) by 0 days.

(21) Appl. No.: 10/387,260

(22) Filed: Mar. 12, 2003

(51) Int. Cl.[7] ..... D06F 71/36
(52) U.S. Cl. ..... 38/20; 38/21; 223/57
(58) Field of Search ..... 38/12, 13, 20, 38/25, 27, 31, 30, 32, 33, 34, 75; 223/52.1, 68, 72, 73, 52.5, 61, 57, 74, 67, 70

(56) References Cited

U.S. PATENT DOCUMENTS 2,315,690 A * 4/1943 Davis ..... 223/57
2,328,229 A * 8/1943 Pearson ..... 223/57
2,521,374 A * 9/1950 Johnson ..... 38/12
2,626,733 A * 1/1953 Maxwell et al. ..... 223/57

* cited by examiner

*Primary Examiner*—Ismael Izaguirre
(74) *Attorney, Agent, or Firm*—Andrus, Sceales, Starke & Sawall

(57) ABSTRACT

The present invention enables the cloth shrunk through its washing to be finished in press to such a state as found in its new product. The present invention is comprised of a buck having a protruded curved upper surface on which a collar of the shirts 1 is mounted and a press iron having a concave curved iron surface for depressing the upper surface of the buck. A radius of curvature of the upper surface of the buck is selected to be larger than a radius of curvature of the iron surface of the press iron. The buck is divided at its central position into a right segment and a left segment so as to form a pair of right and left divided members. There is provided a depressing mechanism for turning each of the divided segments in an upward and outward direction at the time of pressing at the collar.

7 Claims, 15 Drawing Sheets

SHIRTS PRESS WITH FUNCTION FOR EXTENDING CLOTH

BACKGROUND OF THE INVENTION

1. Field of the Invention

This invention relates to a shirts press for use in pressing a shirts such as a washed shirts or the like, and more particularly to a shirts press in which a collar and cuffs shrunk after washing can be extended and finished in press.

2. Description of the Related Art

As this type of press in the prior art, there has been provided the invention described in a gazette of U.S. Pat. No. 4,843,745, for example. This prior art press is constituted by a buck for a collar, bucks for cuffs arranged at both sides of the former buck and a press head for pressing once from above the collar and cuffs of the shirts set on these bucks.

However, this prior art press was operated such that a collar and cuffs are merely pressed with the press head to finish them. Accordingly, this type of prior art press had a problem that a press wrinkle is easily generated at the collar and cuffs and a shirts cannot be pressed in a neat manner.

The present invention has been provided in view of the prior art problems.

Accordingly, a technical issue of the present invention consists in providing the shirts press constructed such that the collar and cuffs shrunk through washing can be extended at first and then pressed to finish the shirts in a neat manner.

SUMMARY OF THE INVENTION

The present invention is operated such that an upper surface of the buck and an iron surface of a press iron are formed with their radii of curvature being made different from each other, both side segments of a collar are fixed at first by the descending press iron, then a pair of right and left divided members are pushed open by a pressing mechanism in an upper outward direction and an entire shirts including the center of the collar is pushed against the iron surface of the press iron. Accordingly, in the case of the present invention, the collar can be press finished under a state in which the collar shrunk through washing is extended, so that the press of the present invention enables the collar to be finished in a neat manner. If the pressing mechanism enables each of the divided members to be turned in an upward and outer direction, its structure and fixing position might be optional.

In this way, the aforesaid depressing mechanism is constructed more practically, as shown in FIG. 1 and the like, to have a cylinder device having a rod extending along an upward or downward direction and arranged at a fixed segment of a buck in a raised state, a block member ascended or descended under an extending or retracting action of a rod of the cylinder device, rollers engaged with both side surfaces of the block member, the aforesaid cylinder device is arranged at the aforesaid fixing segment in response to the central position of the buck, the aforesaid block member causes both side surfaces engaged with the rollers to be curved in a crank shape which is a substantial protruded shape as seen in its front elevational view, and it is preferable that the aforesaid rollers are arranged at each of the divided members in a symmetrical manner (claim 2).

Because in the case of this depressing mechanism, it is satisfactory that one cylinder device acting as an operating source is placed at the central position of the fixing segment of the buck, its structure can be simplified, efficient operation can be carried out with a less number of components and each of the divided members can be pushed and opened.

In addition, in the case of the present invention, it is also applicable that the aforesaid block member is formed to be a substantial isosceles triangle as seen in its front elevational view in a fine extremity end toward the upper end as shown in FIG. 11 (claim 3).

In this case, it is satisfactory that both side surfaces of the block member are merely machined into a slant planer shape, so that the present invention has some advantages that machining of the block member becomes easy,.a machining cost of the block member and manufacturing cost can be made less-expensive. In this case, the substantial isosceles triangle is meant by a shape also including a trapezoid (refer to FIG. 11B) as well as isosceles triangle (refer to FIG. 11A).

In addition, it is preferable in the present invention that the springs for use in turning each of the divided members pushed up through an ascending of the block member in a downward direction and returning it back are arranged between a lower position near outside of each of the divided members and the fixing segment of the buck (claim 4).

Because, in this case, the divided members can be forcedly returned with a resilient force of the springs as compared with the case that the divided members are turned downward by their own weight and returned, and the returning action of the divided members can be made smooth and fast.

In addition, in the case of the present invention, as shown in FIG. 8, it is preferable that the padding of the buck is made such that a planer material of aramid fiber is applied as a lower surface and felt is overlapped on the planer material (claim 5).

Aramid fiber has high strength or high modulus of elasticity and shows a superior heat-resistant characteristic. In the case of the present invention, the pudding is formed under combination of the planer material of aramid fiber and felt. Accordingly, assembling of the buck can be made easy without reducing a supporting force against the iron pressure of the press iron and a weight of the buck can be made light as compared with that for forming the padding by arranging many springs as found in the prior art product.

In addition, as shown in FIG. 7 and the like, the present invention is preferably set such that a depth of the upper surface of the buck is selected as such a length as one in which the collar of the shirts can be mounted while being faced from the front side to the rear side of the buck and there are provided receiving members (refer to FIG. 3 and the like) for use in receiving the shirts at the front side and the rear side of the buck (claim 6).

Because, in accordance with this arrangement, it is possible to perform a simultaneous finishing of two pieces of shirts and an efficient pressing operation.

Further, as shown in FIG. 2 and the like, it is preferable in the present invention that each of the cuff press devices for pressing the cuffs of the shirts (refer to FIG. 12) is arranged at both sides of the buck in a lateral direction while being adjacent to the buck (claim 7).

Although the press machine of the present invention is also applicable as one which is made as an exclusive machine for use in finishing the collar, normally, as shown in FIG. 2 and the like, the cuff press device for use in press finishing the cuffs of a shirts is arranged adjacent to the buck. In the case that the device is made as described above, it shows some advantages that the cuffs of a shirts can be finished in press together with the collar and work efficiency becomes improved.

Thus, as shown in FIGS. 12 to 15, the cuff press device of the present invention is preferably comprised of the mountain-shaped lower iron on which the cuffs are mounted, and an upper iron for depressing the cuffs mounted on the lower iron and finishing them in press, the aforesaid lower iron is divided into an upper segment and a lower segment, i.e. an upper fixed segment and a lower movable segment, the upper fixed segment is fixed to the upper segment of the supporting member passed through the lower movable segment and arranged in a raised state, the lower movable segment is made low to a state in which a position of the cuff button and a position of the buttonhole are abutted against both slant surfaces are slightly bulged out of the both slant surfaces of the upper fixed segment and the lower movable segment is formed such that it can be depressed by the upper iron for depressing both slant surfaces (claim 8).

Because, in accordance with this arrangement, the pressing work can be carried out while not only the collar but also the cuffs can be extended and the shirts can be finished in more neat state.

In addition, in the case of the present invention, it is preferable that the cuff press device is constructed as shown in FIGS. 16 and 17. That is, the cuff press device of the present invention is preferably comprised of the mountain-shaped lower iron on which the cuffs are mounted, and an upper iron for depressing the cuffs mounted on the lower iron and finishing them in press, the aforesaid lower iron is divided into an upper segment and a lower segment, i.e. an upper movable segment and a lower fixed segment, the upper movable segment is fixed to the upper part of the piston rod passed through the lower fixed segment and arranged in a raised state, the lower fixed segment is made low to a state in which a position of the cuff button and a position of the buttonhole are abutted against both slant surfaces, both slant surfaces of the lower fixed segment are slightly bulged out of the both slant surfaces of the upper movable segment and the upper movable segment is formed such that it can be depressed against the upper iron under the extending action of the piston rod of the cylinder (claim 9).

In this way, as the shirts press of the present invention for use in finishing the cuffs, there are provided some devices showing a feature of the aforesaid structures (claims 10 and 11). In the case of the present invention, since the cuffs can be finished in press while being forcedly extended, utilization of the press device enables the cuffs to be finished in neat state.

BRIEF DESCRIPTION OF THE DRAWINGS

The aforesaid and other objects and features of the present invention will become more apparent from the following detailed description and the accompanying drawings.

DETAILED DESCRIPTION OF THE PREFERRED EMBODIMENTS

Referring now to the accompanying drawings, one preferred embodiment of the present invention will be described as follows.

Figure 1:
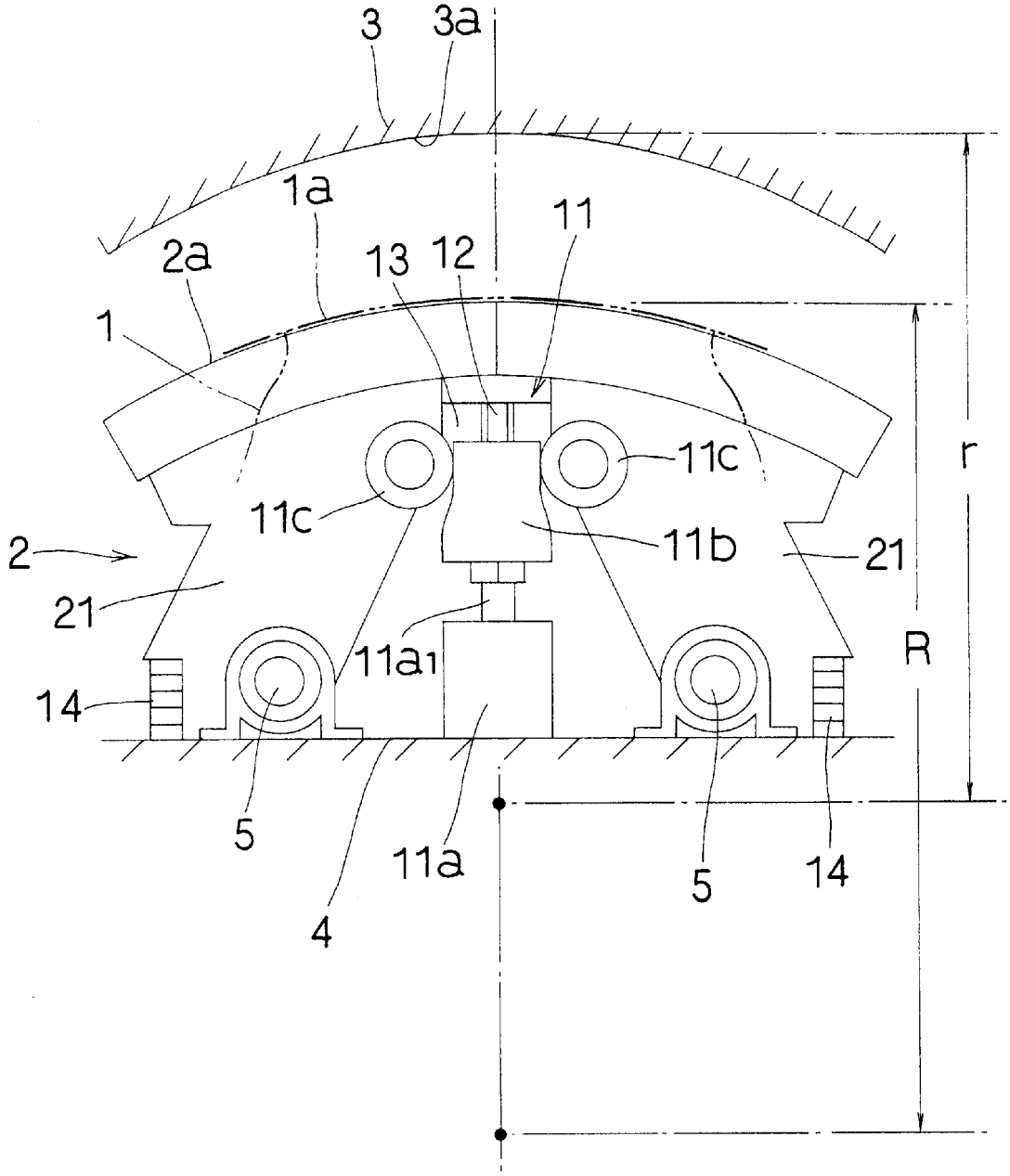
FIG. 1 is a substantial front elevational view for showing one preferred embodiment of a press of the present invention.

In FIG. 1 and other figures, reference numeral 1 denotes the shirts such as a white shirts or the like, reference symbol 1*a* denotes a collar of the shirts 1. Reference numeral 2 denotes a buck having a protruded curved upper surface 2*a* on which the collar 1*a* of the shirts 1 is mounted. Reference numeral 3 denotes a press iron having a concave curved iron surface 3*a* for use in pressing against the upper surface 2*a* of the buck 2.

The aforesaid buck 2 is set such that a radius of curvature R of the upper surface 2*a* is larger than a radius of curvature r of the iron surface 3*a* of the press iron 3. Accordingly, in the case of the present invention, when the press iron 3 presses against the buck 2, both ends of the collar la of the shirts 1 are fixed at first by the iron surface 3*a* of the press iron 3 and the upper surface 2*a* of the buck 2. The buck 2 is divided into a right segment and a left segment at its central position and formed by a pair of right and left divided members 21, 21. Each of these divided members 21 is rotatably attached to a fixing part 4 of the buck 2 through shafts 5.

In addition, a padding 2*b* (refer to FIG. 8) of the buck 2 in this embodiment is formed such that a planer material 2*b*1 of aramid fiber is applied as its lower layer and a felt 2*b*2 is overlapped on the planer material 2*b*1. Reference symbol 2*c* denotes a cloth cover covering the padding 2*b*.

A depth D of the upper surface 2*a* of the buck 2 (refer to FIG. 7) is selected and set to such a size as one in which the collars 1*a* of the shirts 1 can be mounted while they are faced from each other at front and rear sides. Reference numeral 6 denotes receiving members for receiving the shirts 1 set at the buck 2. The receiving members 6 are formed into a plate-like member, for example, and are arranged at a front side and a rear side of the buck 2.

Figure 3:
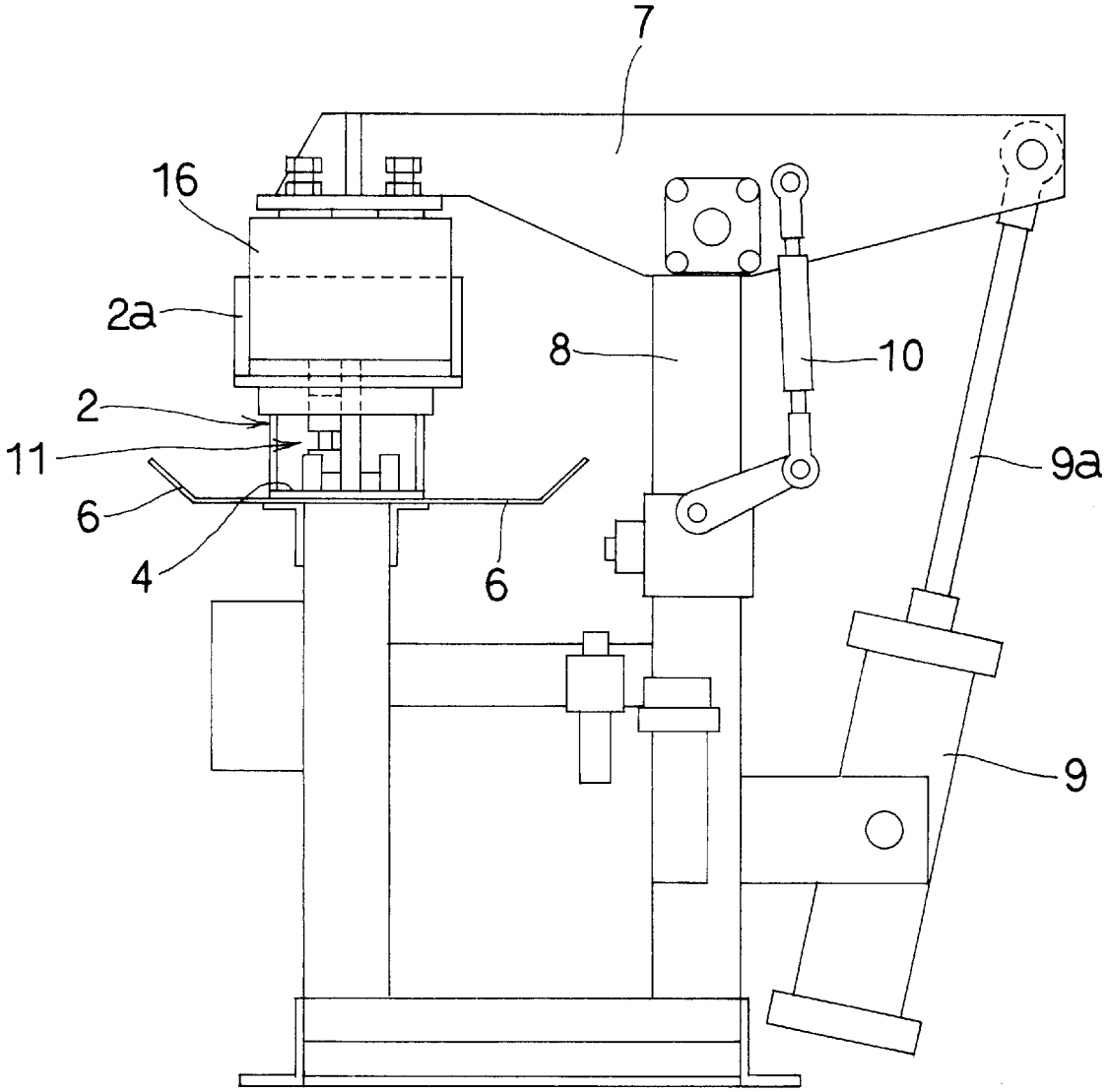
FIG. 3 is a right side elevational view for showing a press of the present invention.
Figure 4:
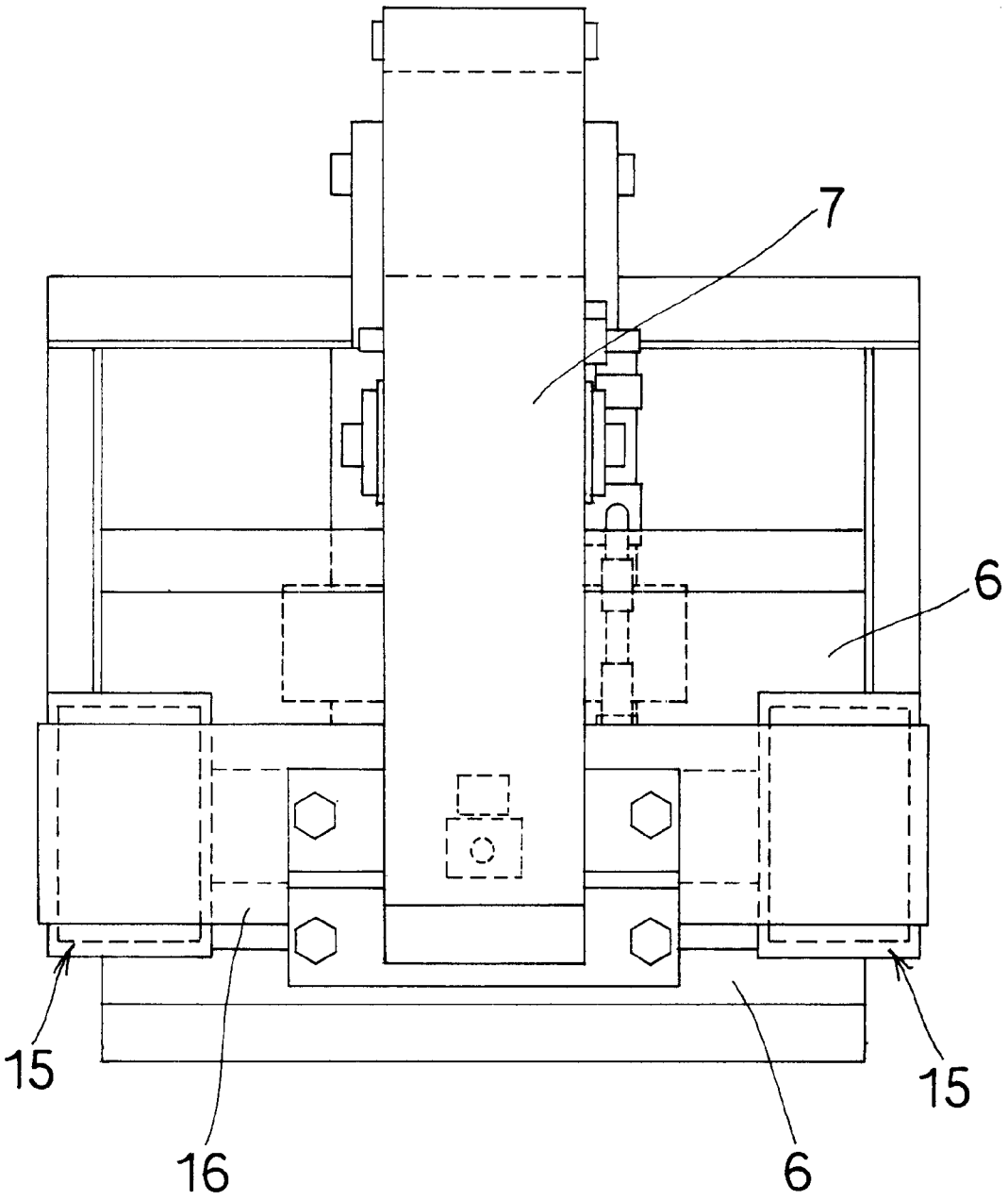
FIG. 4 is a top plan view for showing a press of the present invention.
Figure 5:
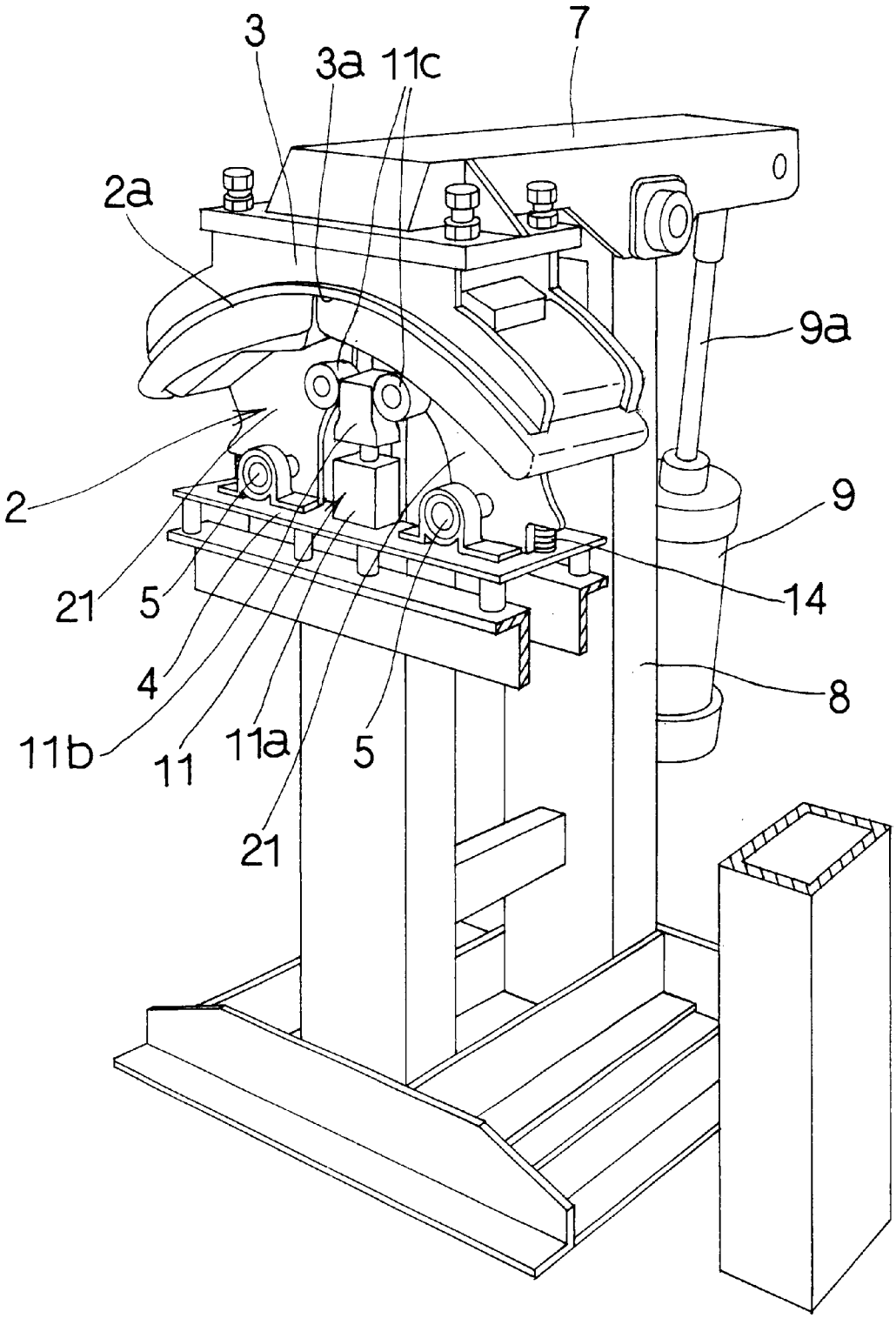
FIG. 5 is a substantial perspective view for showing a press of the present invention.
Figure 6:
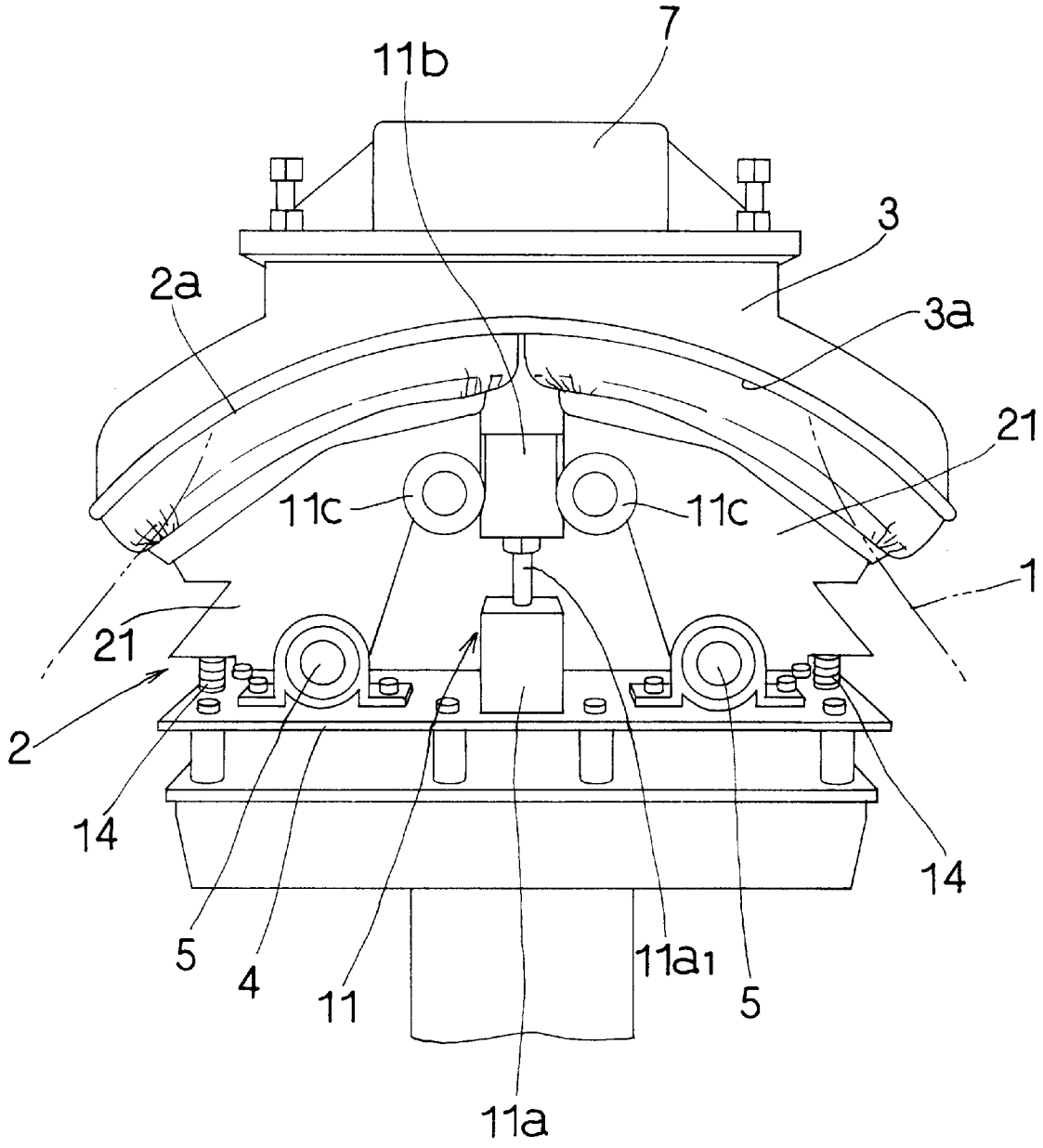
FIG. 6 is a substantial perspective view as seen from a front side of a press of the present invention.

In addition, the aforesaid press iron 3 is formed in such a way that steam is supplied into the aforesaid press iron 3 to heat the iron surface 3*a*. In addition, reference numeral 7 (refer to FIG. 3) is a supporting member where the press iron 3 is fixed at its front end. This supporting member 7 is attached at the upper end of a supporting column 8 in such a way that it can be turned in a forward or rearward direction. Reference numeral 9 denotes a cylinder in which an upper end of a rod 9*a* is pivotally attached to a rear end of the supporting member 7. When the rod 9*a* of this cylinder 9 is extended or retracted, the press iron 3 is pivotally turned through the supporting member 7 in a forward or rearward direction to press against the upper surface 2*a* of the buck 2, or after pressing action, it is turned rearward and retracted. Further, reference numeral 10 denotes a shock absorber.

In addition, reference numeral 11 denotes a depressing mechanism for turning each of the aforesaid divided members 21 in an upward and outward direction when the collars 1*a* are pressed and for pushing it against the iron surface 3*a* of the press iron 3. This depressing mechanism 11 in this embodiment is constituted by a cylinder device 11*a* having its rod 11*a*1 extending along its upward or downward direction and arranged at the fixing part 4 of the buck 2 in a raised state; a block member 11*b* ascended or descended through extending or retracting action of the rod 11*a*1 of the cylinder device 11*a*; and rollers 11*c* engaged with both side surfaces of the block member 11*b*.

Figure 10:
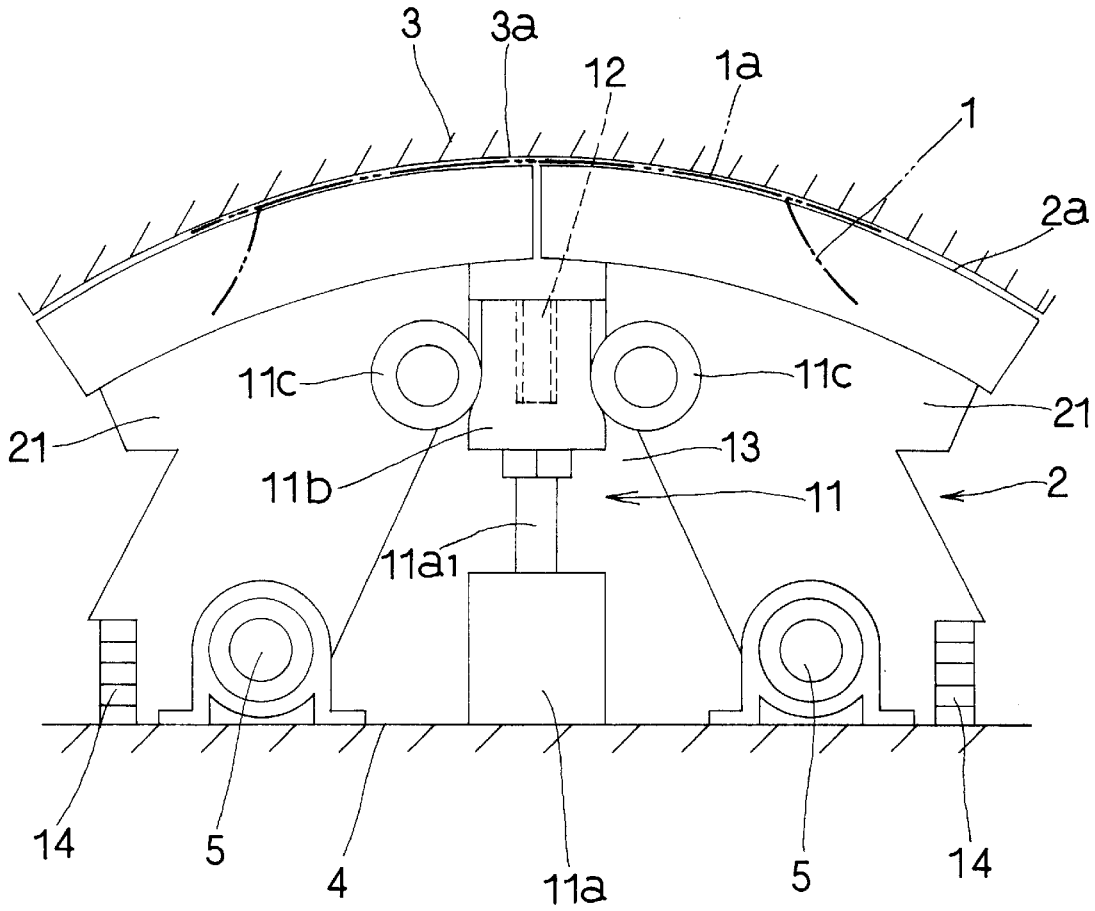
FIG. 10 is a substantial front elevational view for illustrating an action of a press of the present invention.
Figure 11A:
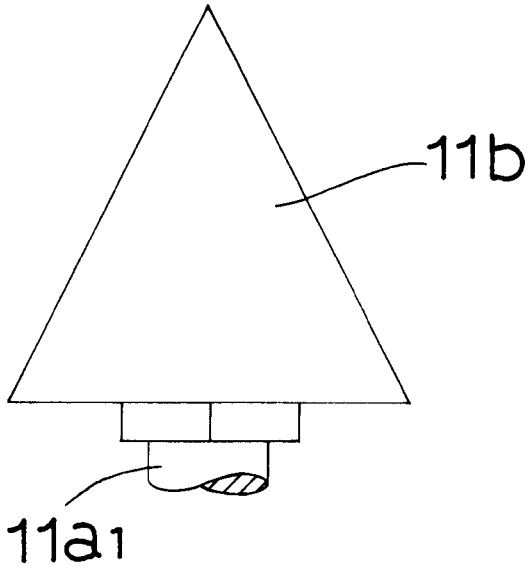
FIG. 11A and FIG. 11B are a substantial front elevational view with a part being cut away for showing another embodiment of a block member.
Figure 11B:
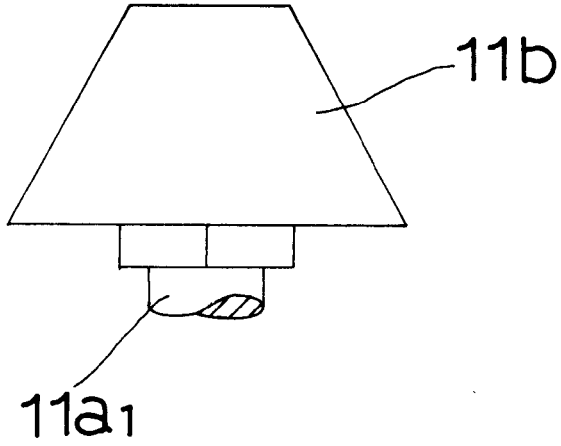

The cylinder device 11*a* having the end of the rod 11*a*1 extending aong its upward direction is arranged at the fixing part 4 corresponding to the central position of the buck 2. The said block member 11*b* is connected to th end of rod 11*a*1 of the cylinder device 11*a*. In addition, this block member 11*b* is constructed such that its both side surfaces engaging with the rollers 11*c* are curved into a crank-shape and formed into a substantial protruded shape as seen in its front elevational view. Reference numeral 12 (refer to FIG. 1 and FIG. 10) denotes a guide member for use in guiding the block member 11*b* in an upward or downward direction. In the case of this embodiment, a vertical wall 13 is formed at a rear side of the buck 2 in order to stabilize an ascending or descending action of the block member 11*b*, the guide member 12 is fixed to the vertical wall 13 and the block member 11*b* is slidably engaged with the guide member 12. The aforesaid rollers 11*c* are arranged in a symmetrical manner at each of the divided members 21.

Reference numeral 14 denotes a spring for use in turning each of the divided members 21 pushed by the ascending action of the block member 11*b* downwardly and returning. Each of the springs 14 is arranged between an outward lower position of each of the divided members 21 and the fixing part 4 of the buck 2.

Figure 2:
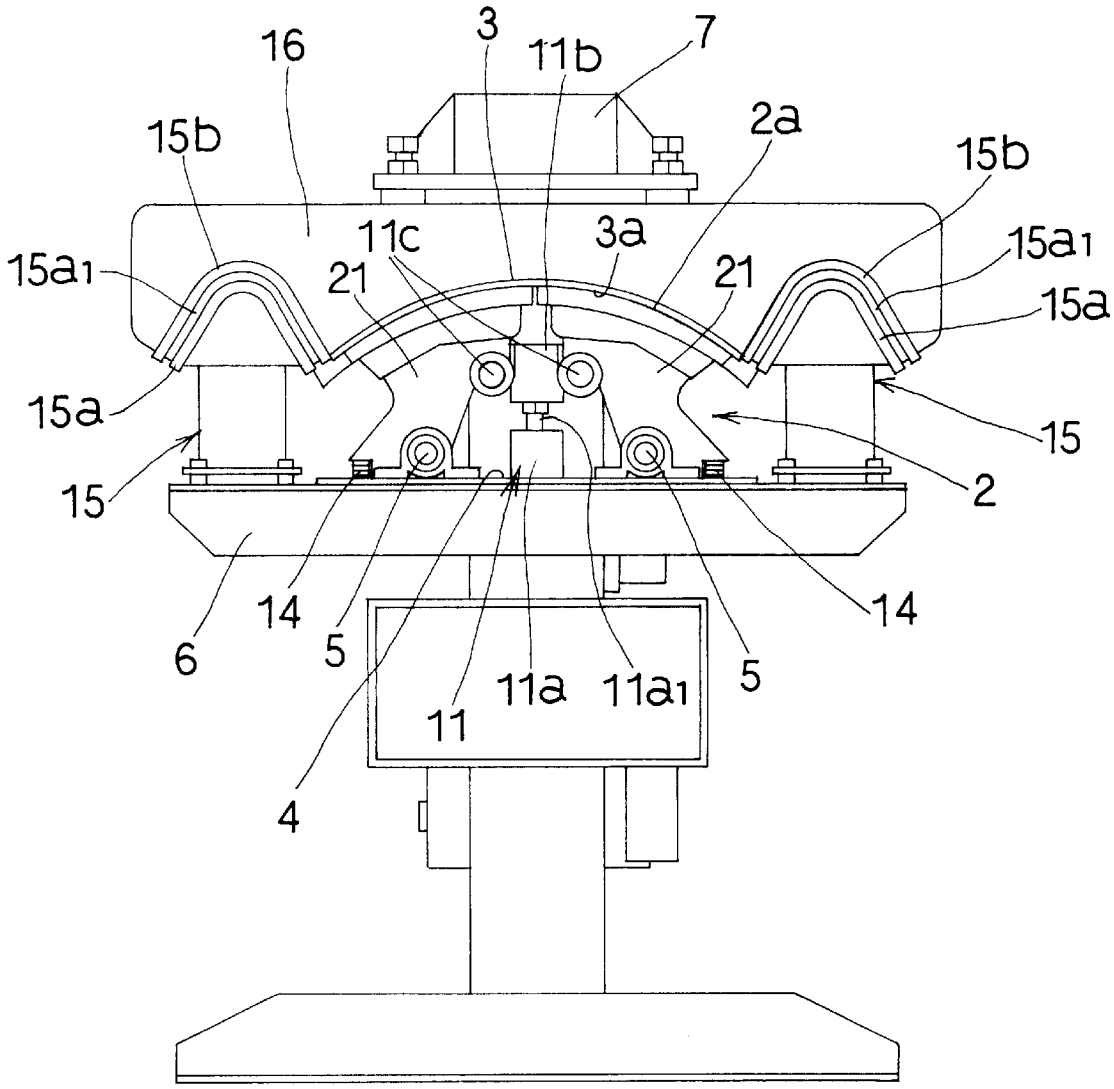
FIG. 2 is a front elevational view for showing a press of the present invention.

Further, reference numeral 15 (refer to FIG. 2 and the like) denotes a cuff press for use in pressing cuffs 1*b* of the shirts 1. Each of the cuff presses 15 is placed adjacent to the buck 2 and arranged at both sides in a lateral direction. The cuff press 15 is comprised of a mountain-shaped lower iron 15*a* on which the cuff 1*b* (refer to FIG. 12 and the like) is mounted, and an upper iron 15*b* for depressing the cuff 1*b* mounted on the lower iron 15*a* and pressing it.

The aforesaid lower iron 15*a* is provided with a padding member 15*a*1. In the case of this embodiment, the aforesaid upper iron 15*b* and the press iron 3 are connected by a connector member 16 and integrally formed, wherein the collar 1*a* and the cuff 1*b* can be pressed simultaneously under an extending or retracting action of the rod 9*a* of the cylinder 9.

Action of the present invention will be described in reference to FIG. 1 and the like.

Figure 7:
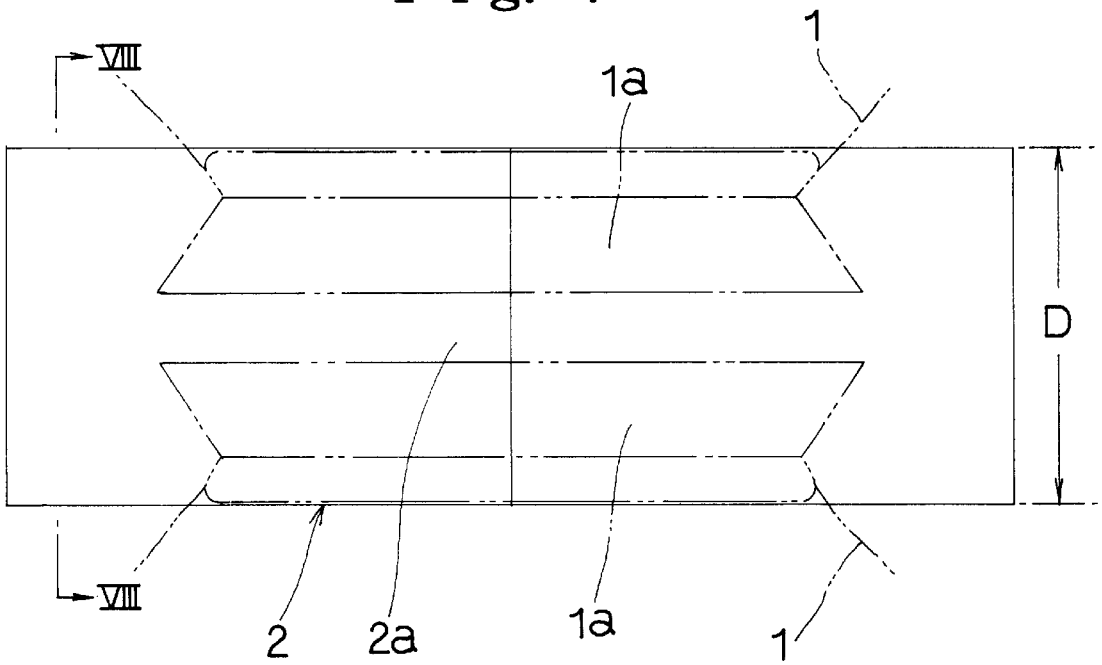
FIG. 7 is a top plan view for showing a buck.
Figure 8:
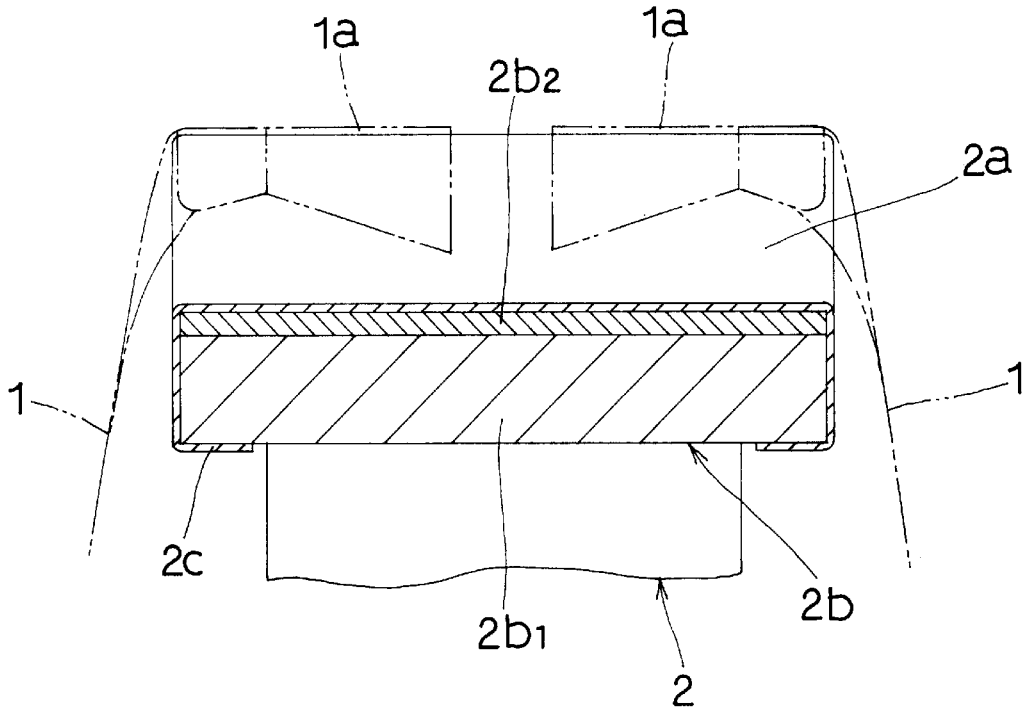
FIG. 8 is a substantial sectional view taken along line VIII—VIII of FIG. 7.
Figure 9:
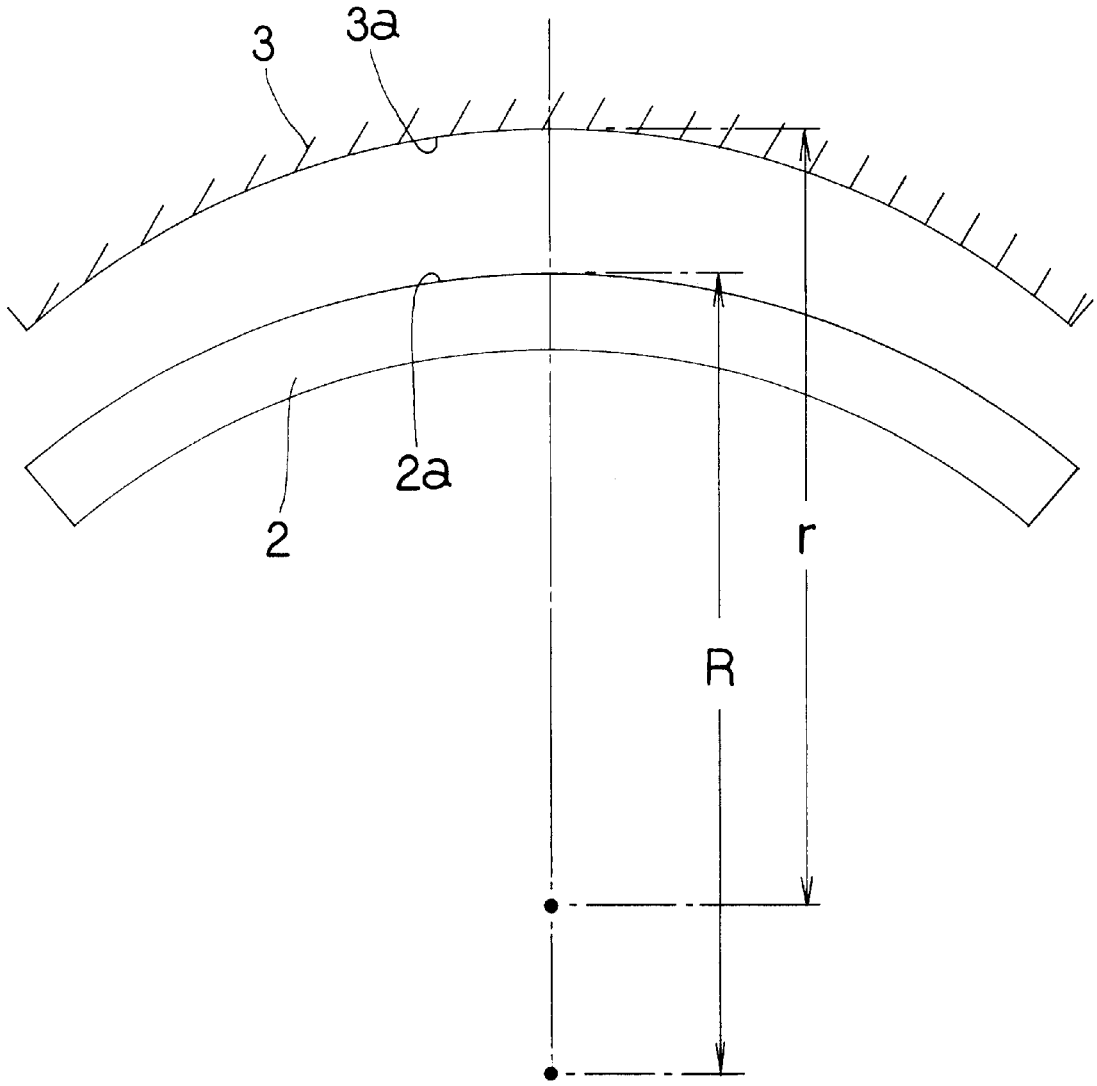
FIG. 9 is a substantial configuration view for showing a relation between an upper surface of a buck and an iron surface of a press iron.

At first, an operator puts the collar 1*a* of the shirts 1 on the upper surface 2*a* of the buck 2 with its rear surface being faced front (refer to FIG. 1). In this case, the depth D of the buck 2 is formed long as shown in FIG. 7 and FIG. 8 in this embodiment, so that the operator mounts the collar 1*a* of the shirts 1 on the upper surface 2*a* of the buck 2 from the front side and the rear side of the buck 2 while the collar 1*a* being oppositely faced against it, and then the skirt or the like of the shirts is supported on the receiving members 6.

Then, the operator drives the cylinder 9 to extend the rod 9*a*. With this operation performed, the press iron 3 and the upper iron 15*b* are turned downward to depress the buck 2 and the lower iron 15*a* (refer to the states shown in FIGS. 2 to 5). In this case, the radius of curvature R of the upper surface 2*a* of the buck 2 and the radius of curvature r of the iron surface 3*a* of the press iron 3 are set such that the former is longer than the latter, so that both sides of the collar 1*a* of the shirts 1 are fixed on the buck 2 with the press iron 3. Then, this state is kept for a predetermined time (5 seconds, for example) and the central position of the collar 1*a* not applied with the press pressure is steamed at first.

Then, as a predetermined time elapses, the cylinder device 11*a* is driven to cause the rod 11*a*1 to be extended. As a result, the block member 11*b* ascends together with the rod 11*a*1, each of the divided members 21 is pushed open toward an upward and outward direction through rollers 11*c* engaged with both side surfaces of the block member 11*b* and then the collars 1*a* is pushed against the iron surface 3*a* of the press iron 3 (refer to FIG. 10). With such an operation as above, the collar 1*a* is pressed and finished while being extended. Then, as a predetermined time elapses, the rod 9*a* of the cylinder 9 is retracted, the press iron 3 and the upper iron 15*b* are moved away from the buck 2 and the lower iron 15*a*, the rod 11*a*1 of the cylinder device 11*a* is retracted and the block member 11*b* descends. With such an operation as above, the spring 14 causes each of the divided members 21 to be pivoted around the shaft 5 downward with a retention force of the spring and forcedly returns it.

Then, referring to FIG. 12 and the like, one embodiment of the present invention for use in extending the cuff 1*b* and finishing it will be described as follows. The same location and the same members as those of the aforesaid example are denoted by the same reference symbols and their detailed description will be eliminated.

The present invention is comprised of a mountain-shaped lower iron 15*a* on which the cuff 1*b* of the shirts 1 is mounted, and the upper iron 15*b* (refer to FIG. 14 and the like) for use in depressing the cuff 1*b* mounted on the lower iron 15*a* to finish in press of the cuff 1*b*. The aforesaid lower iron 15*a* is divided into an upper segment and a lower segment, i.e. an upper fixed segment 151 and a lower movable segment 152.

Figure 14:
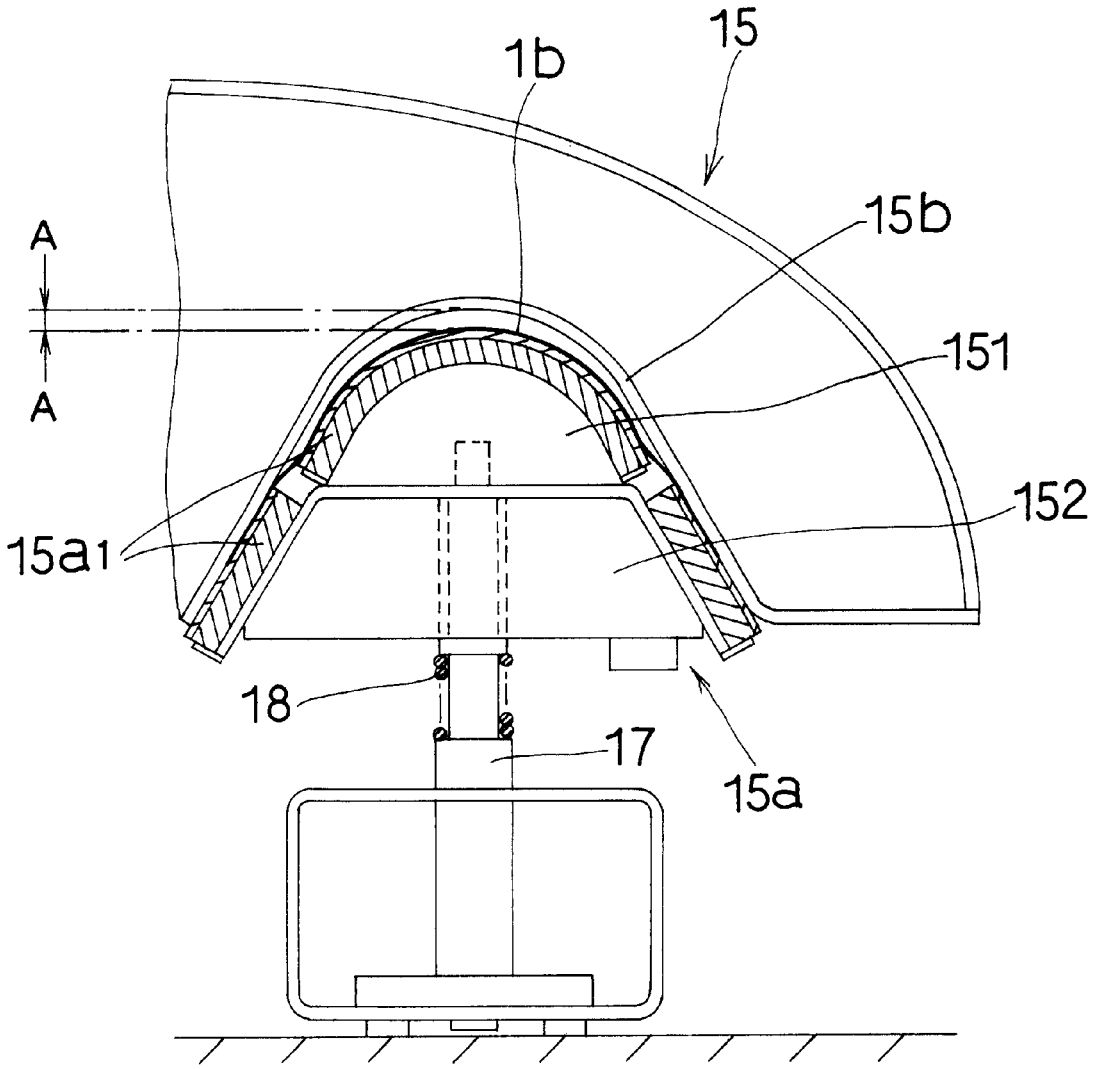
FIG. 14 is a substantial front elevational view for illustrating an action of the present invention shown in FIG. 12.
Figure 15:
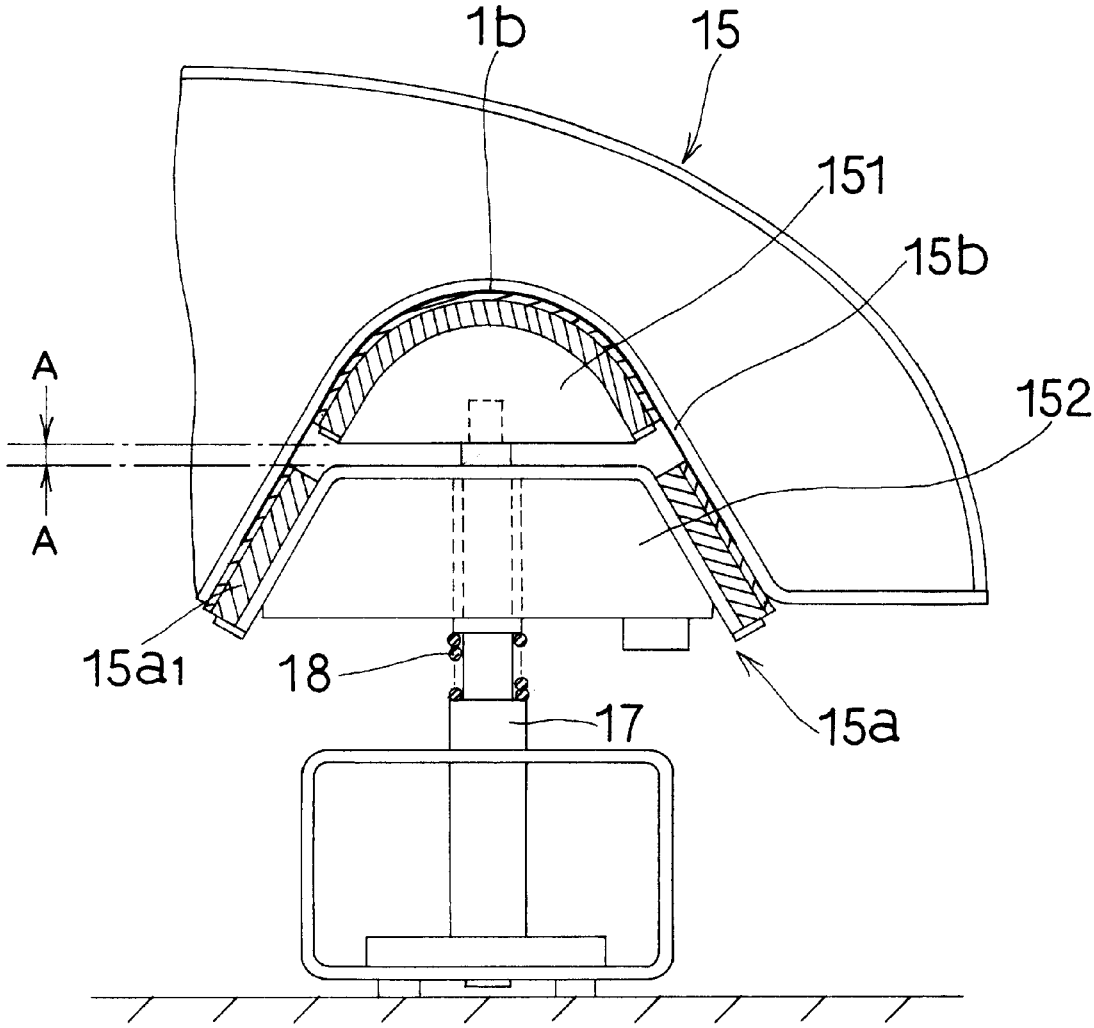
FIG. 15 is a substantial front elevational view for illustrating an action of the present invention shown in FIG. 12.

The upper fixed segment 151 is fixed to upper sides of the supporting members 17 passing through the lower movable segment 152 and arranged in a raised manner. The supporting members 17 in this embodiment are formed like column manner at a forward position and a rearward position, respectively. The lower movable segment 152 is formed to be low under a state in which a position of the button 1*b*1 of the cuff 1*b* (refer to FIG. 13) and a position of a buttonhole 1*b*2 are applied to both slant surfaces. Both slant surfaces of the lower movable segment 152 are slightly protruded outward from both slant surfaces of the upper fixed segment 151. With this arrangement as above, in the case of the present invention, the lower movable segment 152 is formed such that it can be depressed with the upper iron 15*b* for depressing both slant surfaces. In FIGS. 14 and 15, reference letter A denotes a distance where the upper iron 15*b* moves the lower movable segment 152 downward. In addition, reference numeral 18 denotes a spring for use in recovering the lower movable segment 152.

Then, an action of the present invention will be described as follows.

Figure 12:
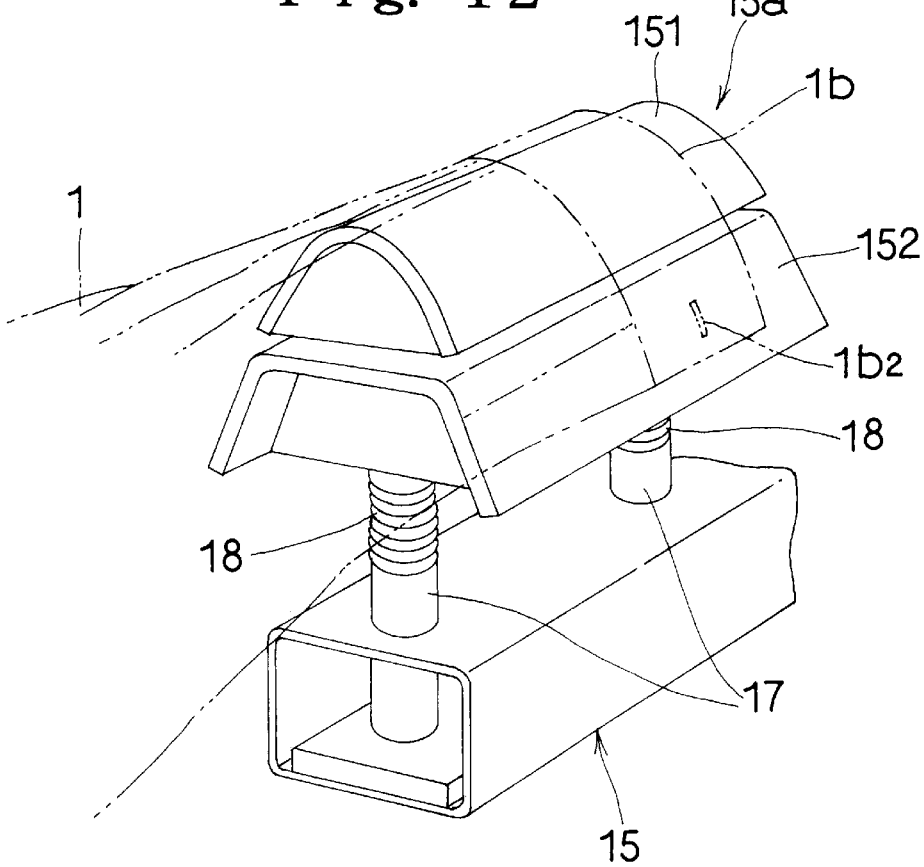
FIG. 12 is a substantial perspective view for showing one preferred embodiment of the present invention for finishing a cuff.
Figure 13:
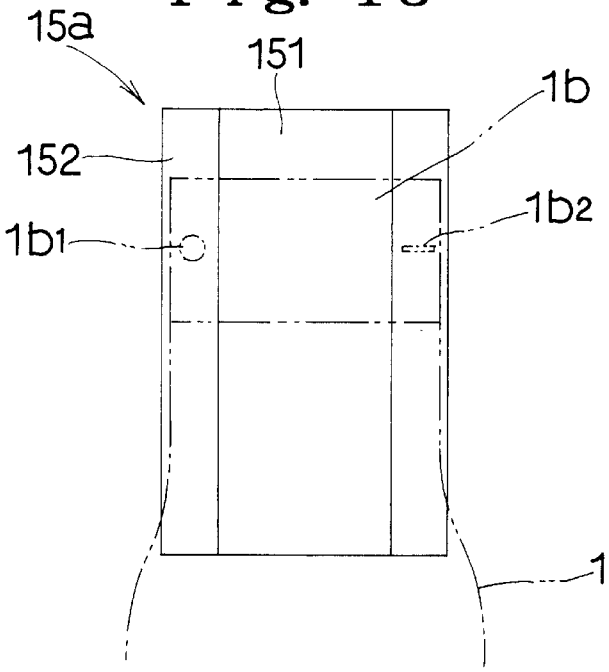
FIG. 13 is a substantial top plan view for showing the present invention shown in FIG. 12.

At first, as shown in FIGS. 12 and 13, an operator mounts and sets the cuff 1*b* on the lower iron 15*a*. Then, the operator lowers the upper iron 15*b* under this state. Then, as shown in FIG. 14, the upper iron 15*b* abuts against both slant surfaces of the lower movable segment 152 to hold a position of the button 1*b*1 of the cuff 1*b* and a position of the buttonhole 1*b*2 and push down the lower movable segment 152 under this state. As a result, as shown in FIG. 15, the cuff 1*b* is pulled down only by the distance A, the upper iron 15*b* depresses the lower iron 15*a* and the cuff 1*b* is finished in press. Then, as the upper iron 15*b* ascends, the lower movable segment 152 returns with a retention force of the spring 18.

Figure 16:
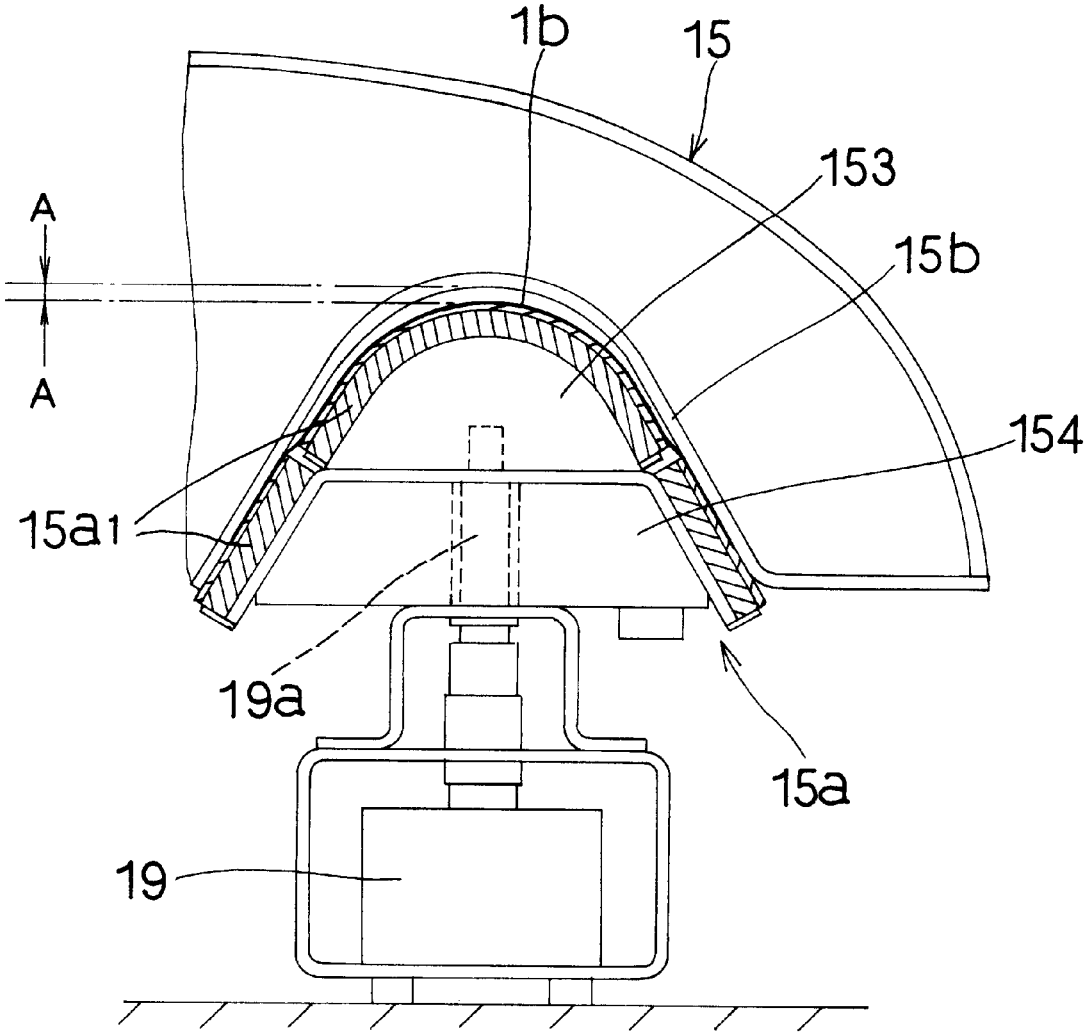
FIG. 16 is a substantial front elevational view for showing another configuration of the present invention in which a cuff is finished.
Figure 17:
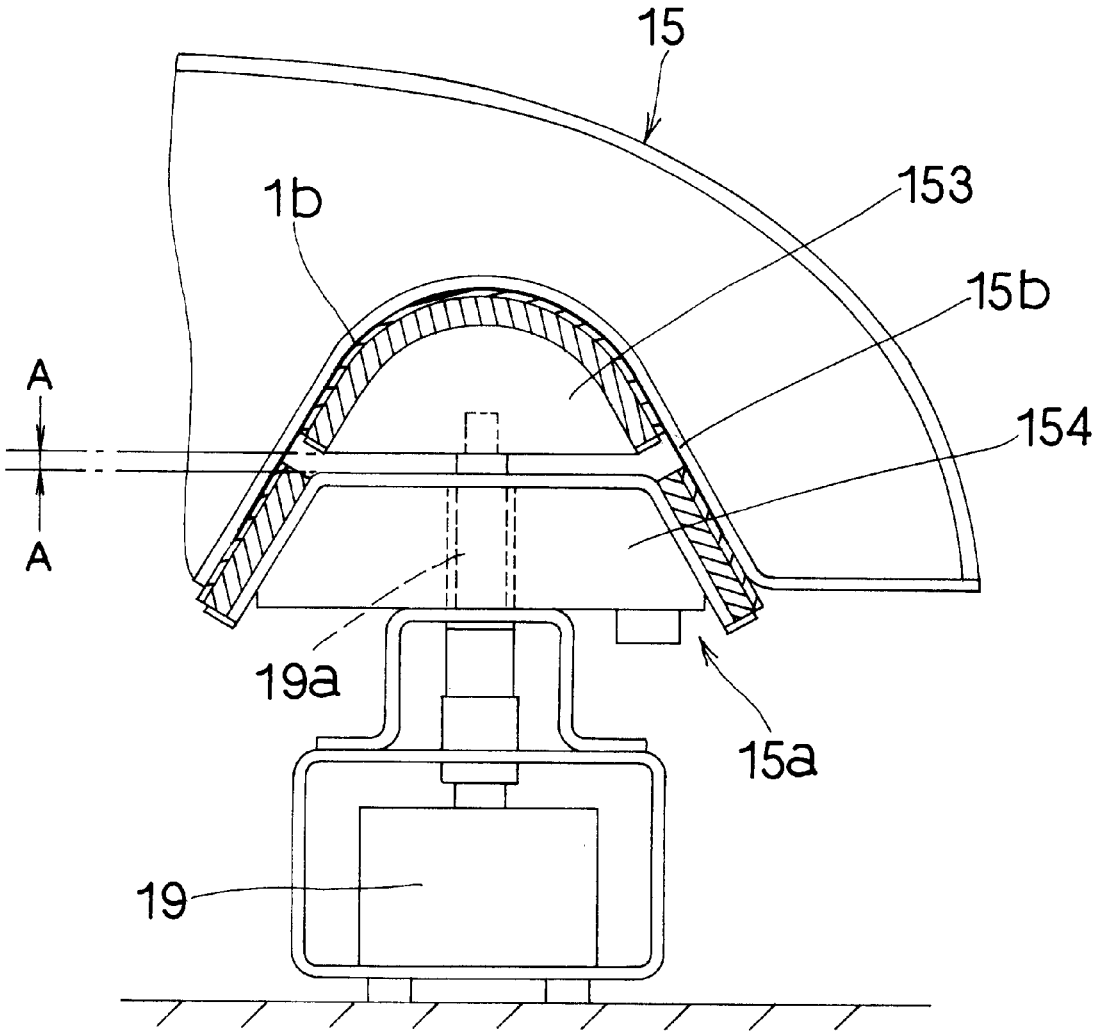
FIG. 17 is a substantial front elevational view for illustrating an action of the present invention-shown in FIG. 16.

In the aforesaid arrangement, it is also preferable that the press for the cuff 1*b* may be constituted as shown in FIGS. 16 and 17. The same location and the same members as those of the aforesaid example are denoted by the same reference symbols and their detailed description will be eliminated.

The present invention is comprised of a mountain-shaped lower iron 15*a* on which the cuff 1*b* of the shirts 1 is mounted and an upper iron 15*b* for depressing the cuff 1*b* mounted on the lower iron 15*a* and finishing it in press. The aforesaid lower iron 15*a* is divided into an upper segment and a lower segment, i.e. an upper movable segment 153 and a lower fixed segment 154. The upper movable segment 153 is fixed to an upper side of the piston rod 19*a* passing through the lower fixed segment 154 and arranged in a raised manner. The lower fixed segment 154 is formed to be low under a state in which a position of the button 1*b*1 of the cuff 1*b* and a position of a buttonhole 1*b*2 are applied to both slant surfaces. Both slant surfaces of the lower fixed segment 154 are slightly protruded outward from both slant surfaces of the upper movable segment 153. The upper movable segment 153 is formed such that it can be depressed against the upper iron 15*b* under an extending action of the piston rod 19*a* of the cylinder 19.

In the case of the present invention, at first the upper iron 15*b* descends, and a position of the button 1*b*1 of the cuff 1*b* and a position of the buttonhole 1*b*2 are held by the upper iron 15*b*. Then, under this state, the piston rod 19*a* of the cylinder 19 extends only by the distance A (refer to FIGS. 16 and 17). With such an operation as above, the cuff 1*b* is pulled upward and the upper movable segment 153 depresses the cuff 1*b* against the upper iron 15*b*. As a result, the cuff 1*b* is finished in press under its extended state.

What is claimed is:

1. A shirts press device comprised of a buck having a protruded curved upper surface on which a collar of a shirts is mounted, and a press iron having a concave curved iron surface for depressing the upper surface of the buck, a radius of curvature of the upper surface of the buck being selected to be larger than a radius of curvature of the iron surface of the press iron, the buck being divided into a right segment and a left segment at its central position to form a pair of right and left divided members, and there being provided a depressing mechanism for turning each of the divided members in an upward and outward direction when the collar is pressed, and pushing it against the iron surface of the press iron, wherein the depressing mechanism is constructed to have a cylinder device having a rod extending along an upward or downward direction and arranged at a fixed segment of a buck in a raised state, a block member ascended or descended under an extending or retracting action of a rod of the cylinder device, rollers engaged with both side surfaces of the block member, said cylinder device is arranged at said fixing segment corresponding to the central position of the buck, said block member causes both side surfaces engaged with the rollers to be curved in a crank shape which is a substantial protruded shape as seen in its front elevational view, and said rollers are arranged at each of the divided members in a symmetrical manner, wherein springs for use in turning each of the divided members pushed up through ascending of the block member in a downward direction and returning it are arranged between a lower and near outer position of each of the divided members and a fixing segment of the buck, wherein the padding of the buck is made such that a planer material of aramid fiber is applied as a lower surface and felt is overlapped on the planer material, and wherein a depth of the upper surface of the buck is selected as such a length as one in which the collar of the shirts can be mounted while being faced from the front side to the rear side of the buck and there are provided receiving members for use in receiving the shirts at the front side and the rear side of the buck.

2. A shirts press device according to claim 1, wherein the block member is formed to be a substantial isosceles triangle as seen in its front elevational view in a fine extremity end toward the upper end in place of both side surfaces engaged with the rollers being curved in a crank shape to form a substantial protruded shape as seen in its front elevational view.

3. A shirts press device according to claim 1, wherein each of a set of cuff press devices for pressing the cuffs of the shirts is arranged at both sides of the buck in a lateral direction while being adjacent to the buck.

4. A shirts press device according to claim 3, wherein each cuff press device is comprised of a mountain-shaped lower iron on which the cuffs are mounted, and an upper iron for depressing the cuffs mounted on the lower iron and finishing them in press, said lower iron is divided into an upper segment and a lower segment to form an upper fixed segment and a lower movable segment, the upper fixed segment is fixed to the upper segment of the supporting member passed through the lower movable segment and arranged in a raised state, the lower movable segment is made low to a state in which a position of the cuff button and a position of the buttonhole are abutted against both slant surfaces are slightly bulged out of both slant surfaces of the upper fixed segment and the lower movable segment is formed such that it can be depressed by the upper iron for depressing both slant surfaces.

5. A shirts press device according to claim 3, wherein each cuff press device is comprised of the mountain-shaped lower iron on which the cuffs are mounted, and an upper iron for depressing the cuffs mounted on the lower iron and finishing them in press, said lower iron is divided into an upper segment and a lower segment to form an upper movable segment and a lower fixed segment, the upper movable segment is fixed to the upper part of the piston rod passed through the lower fixed segment and arranged in a raised state, the lower fixed segment is made low to a state in which a position of the cuff button and a position of the buttonhole are abutted against both slant surfaces, both slant surfaces of the lower fixed segment are slightly bulged out of both slant surfaces of the upper movable segment and the upper movable segment is formed such that it can be depressed against the upper iron under the extending action of the piston rod of the cylinder.

6. A shirts press device comprised of a mountain-shaped lower iron on which the cuffs of a shirts are mounted, and an upper iron for depressing the cuffs mounted on the lower iron and finishing them in press, wherein said lower iron is divided into an upper segment and a lower segment to form an upper fixed segment and a lower movable segment, the upper fixed segment is fixed to an upper part of a supporting member passed through the lower movable segment and arranged in a raised state, the lower movable segment is made low to a state in which a position of the cuff button and a position of the buttonhole are abutted against both slant surfaces, both slant surfaces of the lower movable segment are slightly bulged out of both slant surfaces of the upper fixed segment and the lower movable segment is formed such that it can be depressed against the upper iron under the depressing action against both slant surfaces.

7. A shirts press device comprised of a mountain-shaped lower iron on which the cuffs of a shirts are mounted, and an upper iron for depressing the cuffs mounted on the lower iron and finishing them in press, wherein said lower iron is divided into an upper segment and a lower segment to form an upper movable segment and a lower fixed segment, the upper movable segment is fixed to an upper part of a piston rod passed through the lower fixed segment and arranged in a raised state, the lower fixed segment is made low to a state in which a position of the cuff button and a position of the buttonhole are abutted against both slant surfaces, both slant surfaces of the lower fixed segment are slightly bulged out of both slant surfaces of the upper movable segment and the upper movable segment is formed such that it can be depressed against the upper iron under the extending action of the piston rod of the cylinder.

* * * * *